United States Patent [19]

Schupphaus

[11] 4,451,090

[45] May 29, 1984

[54] ADVANCING APPARATUS FOR COAL-MINING MACHINE IN UNDERGROUND MINE

[75] Inventor: Herbert Schupphaus, Bochum, Fed. Rep. of Germany

[73] Assignee: Gebr. Eickhoff Maschinenfabrik und Eisengiesserei m.b.H., Bochum, Fed. Rep. of Germany

[21] Appl. No.: 366,151

[22] Filed: Apr. 7, 1982

[30] Foreign Application Priority Data

Apr. 25, 1981 [DE] Fed. Rep. of Germany ..... 3116457

[51] Int. Cl.[3] ..... E21C 29/22

[52] U.S. Cl. ..... 299/43

[58] Field of Search ..... 299/42, 43, 51–54; 105/29 R

[56] References Cited

U.S. PATENT DOCUMENTS 4,067,620 1/1978 Lanfermann ..... 299/43

4,166,652 9/1979 Oberste-Beulmann ..... 299/43

FOREIGN PATENT DOCUMENTS 2508069 11/1975 Fed. Rep. of Germany .

1227216 4/1971 United Kingdom .

*Primary Examiner*—Ernest R. Purser

*Attorney, Agent, or Firm*—Thomas H. Murray; Clifford A. Poff

[57] ABSTRACT

A coal-mining machine is advanced along a face conveyor by providing a rack extending along the conveyor and a plurality of advancing units. Each advancing unit includes a hydraulic motor to rotate a drive wheel while meshing with the teeth of the gear rack. The advancing units arranged side-by-side along the mining machine have curved end faces to abut against one another. Runners are provided on the advancing units at the opposite ends of the mining machine which extend partially around the rack for guiding and maintaining the drive wheel engaged with the teeth of the rack.

8 Claims, 4 Drawing Figures

ADVANCING APPARATUS FOR COAL-MINING MACHINE IN UNDERGROUND MINE

BACKGROUND OF THE INVENTION

This invention relates to an apparatus to advance a coal-mining machine along a machine track in an underground mine wherein the advancing apparatus is guided along a rack extending over the length of the machine track and provided with at least one drive wheel to engage with teeth of a rack while connected directly with at least one hydraulic motor, or by way of a transmission, which is supplied with pressurized fluid from a pump coupled to a pump drive motor. The hydraulic motor may receive pressurized fluid by way of fluid conduits extending from the coal-mining machine. The hydraulic motor, fluid pump and its drive motor are preferably mounted on a separate carriage to bear and move along the rack. The carriage is adapted to engage beneath at least part of the rack profile to insure that the teeth of the drive wheel mesh with the teeth of the rack. The carriage forms part of an advancing unit separate from the coal-mining machine.

West German patent publication No. 25 08 069 discloses an advancing system for a mining machine wherein the machine moves along a stationary rail and is provided with pairs of rollers. The pairs of rollers are interconnected by a transmission which can be driven by a single drive motor. The individual rollers are situated on opposite sides of a wedge-shaped rail head and transmit the drive force by frictional engagement with the rail. The drive system is connected to the coal-mining machine by a ball-and-socket joint which moves toward the machine face and transmits some of the machine weight to the rail.

A drum-cutter machine is shown in British Pat. No. 1,227,216 and includes an advancing drive constructed as a separate unit. The advancing drive is movable by friction wheels along a rail having an I-shaped section and disposed on the machine side of a face conveyor. The friction wheels are driven by low-speed hydraulic motors supplied with fluid pressure from a pump associated with the advancing means and having its own drive motor or the hydraulic motors are connected by hoses to a hydraulic unit located inside the body of the drum-cutter machine.

The mining conditions encountered in underground mining operations with drum-cutter machines vary and widely fluctuate. The fluctuating mining conditions apply not only with regard to the nature of the coal to be loosened but also with respect to the condition of the coal seam formation. For example, the seam can be greatly contaminated by rock whereby the seam is difficult to work or one may encounter, in the mining operation with coal-mining machine, difficulties in the areas where the seam is interrupted and where the neighboring rock must also be cut. The coal seam may extend from a previous level position and then assume a considerably inclined position. These different working conditions require an appropriate machine drive which also must be designed with sufficient power to supply the necessary traction force required for the widely-fluctuating mining conditions. Since the individual components of coal-mining machines are mass-produced, the advancing drive for a specific type of mining machine has a fixed drive power output which is sufficient for normal underground seam-working conditions but, in the extreme mining conditions must be increased by an additional second drive in order to assure a required work output by the coal-mining machine.

SUMMARY OF THE INVENTION

It is an object of the present invention to provide an advancing means for a coal-mining machine of the type used in underground mining and particularly more suitable for subsequent fitting to an existing coal-mining machine but which also enables a coal-mining machine to be provided with a required advancing power for a particular place of use when the machine is actually installed.

More particularly, the present invention provides an apparatus for advancing a coal-mining machine along a machine track in an underground mine, the apparatus including the combination of rack means having rack teeth to engage with the drive wheel of each of a plurality of advancing means which is a separate part of the coal-mining machine. Each of the advancing means includes a hydraulic motor with fluid lines extending to a pump means for rotating the drive wheel thereof, each of the advancing means further includes a separate carriage bearing and moving on the rack means while engaged beneath at least part of the rack to insure engagement with the teeth of the drive wheel, at least one of the advancing means being disposed between runners situated on the same side of the coal-mining machine, means for connecting the runners to the body of the coal-mining machine, and means for connecting at least one of the advancing means to bear only on the runner situated in front thereof in the direction of travel by the coal-mining machine along the machine track.

Thus, the present invention provides an advancing apparatus for a coal-mining machine in underground mining operations of the type referred to hereinbefore and provides that one or more of the advancing means is disposed on the rack and between the runners which are situated on the same side of the coal-mining machine. In addition, or instead of the runners, only the advancing means are connected, instead of the runners, to the body of the machine or its frame and act as the runners while other advancing means situated between them or the runners bear only on the advancing means or runner situated in front thereof in the direction of machine travel. The advancing means which are connected to the running machine are also connected to the adjacent advancing means or units. Advancing drive arrangements of this type can be used for the most diverse mining machine types and can, therefore, be made in relatively large numbers and, hence, very economically. By the use of the present invention, it is now possible to equip any coal-mining machine with sufficient power which is required to advance the machine in the place of use in a mine. Moreover, one can boast the driving power by the installation of additional advancing units when extreme mining conditions are encountered.

Advantageously, a carrier for each advancing means has at each end, a runner engaging partly around the profile of the rack and bearing plates at the interconnection with the two runners and pointing in the direction of machine travel. The bearing plates enclose and hold between them the drive wheel, the drive motor or motors and where applicable, a pair of countershaft gear wheels. This type of construction for the individual advancing means provides an easily repaired drive and adequate protection for the drive components against impact from rock.

All of the individual advancing means may be provided with a curved abutment surface at both ends thereof and/or may be interconnected by means of plates for limited movement in all directions. During travel of the mining machine, the individual advancing units bear against one another by their end faces and thus act on the coal-mining machine jointly by way of the runners thereof or by way of an advancing unit acting as a runner to thereby move the mining machine in the longitudinal direction of the mine face. Upon reversal of direction of machine travel, the runner or advancing means at the opposite end of the machine acts as an abutment for the remaining advancing units and transmits the advancing forces to the machine body.

The need to accommodate idling movement by the advancing units between the two machine runners such as occurs with the reversal of the machine travel is eliminated by the use of plates, for example, to fix the position of the advancing units relative to one another. By this arrangement, the front faces of the advancing units are brought into contact with one another so that the advancing units act on the machine runner in front of them in the direction of machine travel or the function of the runner is performed by an advancing unit. However, plates must allow adequate freedom of movement between the individual advancing units so that each unit can adjust to the rack configuration.

It is advantageous to provide that all the hydraulic motors of the advancing units be connected in parallel relationship to a common pump. The drive wheels of the advancing units all engage with the rack and equally share in transmittal of the driving forces. However, when a coal-mining machine is used for mining operations on a steep or sloping mine seam, it is particularly advantageous to provide that at least two hydraulic circuits each having its own fluid pump and fluid circuits for supplying drive energy to different ones of the advancing units. By this arrangement, failure of one of the fluid circuits will prevent a breakdown of the machine since other advancing units continue to receive adequate supplies of a pressurized fluid medium from the remaining fluid circuit.

These features and advantages of the present invention as well as others will be more fully understood when the following description is read in light of the accompanying drawings which illustrate two embodiments of the invention, in which.

Figure 1:
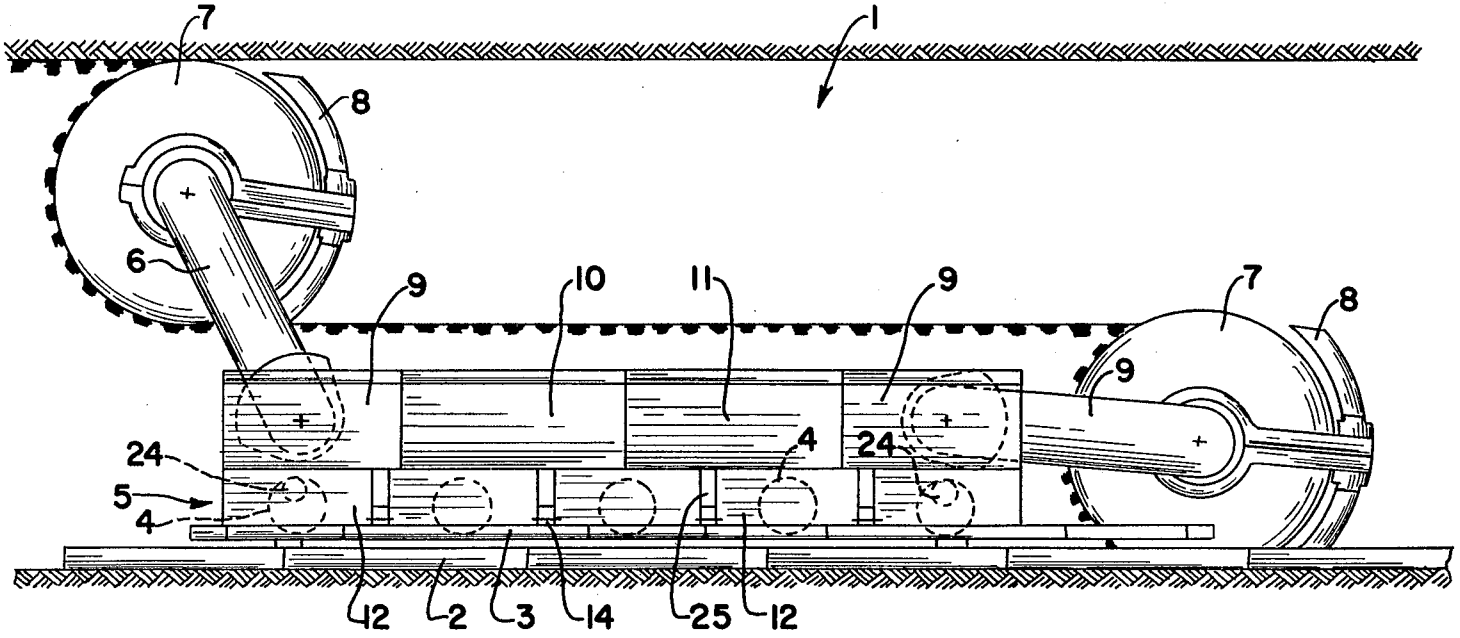
FIG. 1 is a side elevational view of a coal-mining machine embodying the features of the present invention.

In FIG. 1, there is illustrated a coal-mining machine 1 having runners, not shown, on the face side to bear on a cutting ramp extending from a face conveyor 2 that is situated below the coal-mining machine 1. At the machine side of the mining machine the face conveyor 2 is provided with a rack 3 made up of individual rack sections each of which includes gear teeth to mesh with drive wheels 4 of advancing units 5 for producing advancing movement of the mining machine along the mine face. The mining machine 1 includes support arms 6 mounted for pivotal movement about horizontal axes extending traversely of the direction of the machine travel. Each support arm carries a cutter drum 7 and a clearing plate 8 arranged for pivotal movement about the rotational axis of the cutter drum 7. Each support arm 6 is mounted about a pivot axis located inside the machine frame 25 and coupled to an actuating cylinder, not shown, disposed in the region of the face side of the conveyor beneath the mining machine 1.

In the exemplified embodiment of the mining machine shown in FIG. 1, the body of the machine is made up of four units which comprise two machine housings 9 at the opposite ends of the machine body; an intermediate shearing motor unit 10 and a unit 11 which contains electrical controls for the machine, the hydraulic system required for adjusting the support arms 6 and actuating the actuator cylinders, the hydraulic control elements, and means for generating a fluid pressure. The pressure-generating means of unit 11 takes the form of one or more fluid pumps which supply pressurized fluid by way of separate conduits to separate hydraulic motors, each of which is located in one of a plurality of advancing units 12. The fluid pressure is supplied by an arrangement of separate fluid supply lines forming a parallel fluid cicruit.

Figure 4:
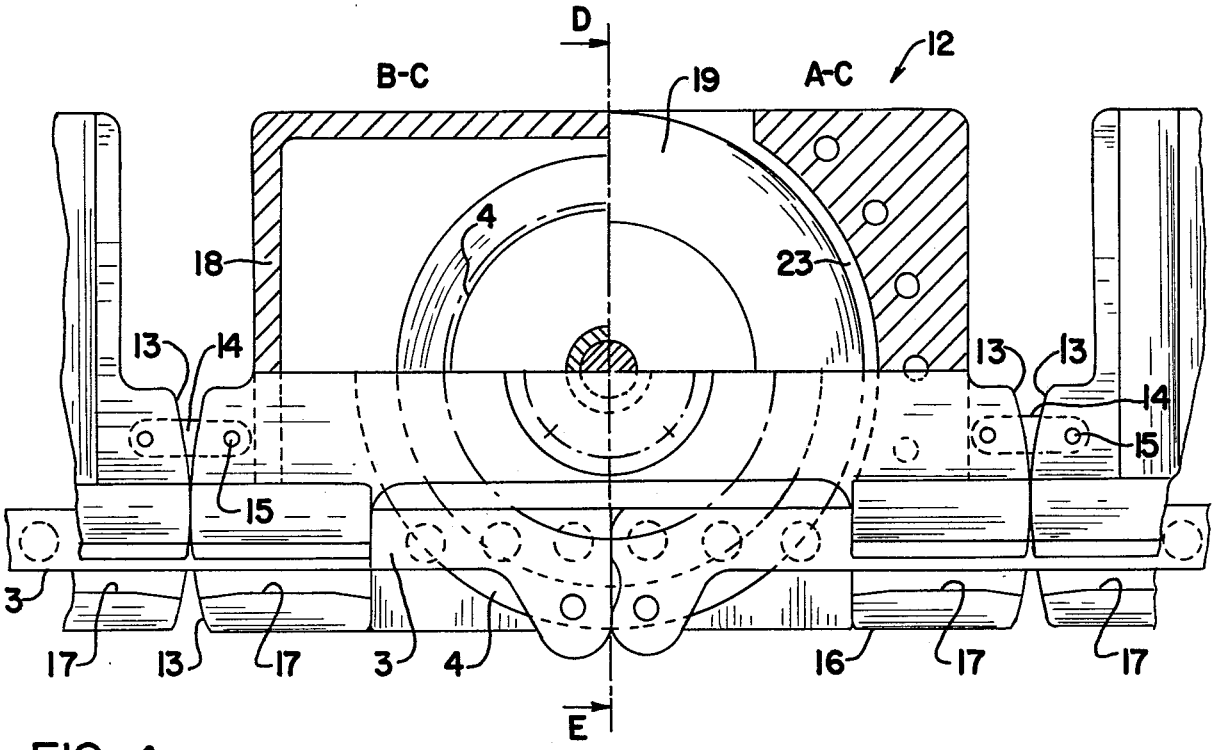
FIG. 4 is a composite sectional view wherein the right-hand portion taken from line D-E is a sectional view along line A-C of FIG. 2 and the left-hand portion from line D-E is a sectional view taken along line B-C of FIG. 2.

The individual advancing units 12 which together form the advancing means for the machine 1, are all disposed for displacement along the rack 3. As shown in FIG. 4, the advancing units 12 each has curved abutment surfaces 13 disposed at their two end faces so that the advancing units can bear against one another. The advancing units are interconnected for limited movement in all directions by plates 14 which are attached to the advancing units by bolts 15.

Figure 2:
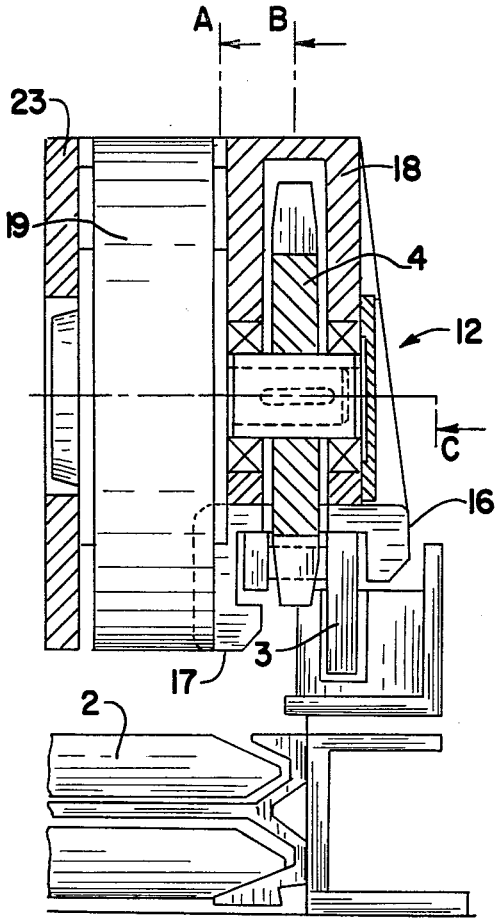
FIG. 2 is a typical sectional view according to one embodiment of the present invention taken along line D-E of FIG. 4.

The embodiment of the present invention shown in FIGS. 2 and 4 provides that each advancing unit 12 includes a carriage 16 with runners 17 disposed at opposite ends of the carriage and partially engaging around the profile of the rack. The runners 17 are connected with bearing plates 18 which point in the direction of machine travel. As described previously, the rack 3 is engaged by the drive wheel 4 which is mounted in the bearing plate 18. A hydraulic low-speed driving motor 19, as shown in FIG. 2, is also mounted in the bearing plate 18. In the further embodiment of the present invention, the bearing plate 18 shown in FIG. 3 carries a plurality of hydraulically-powered high-speed drive motors 20. The output shaft of motors 20 are each provided with a drive wheel 21 that meshes with a pinion gear 21A mounted on a counter-shaft onto which the gear wheel 4 is also mounted. The high-speed drive motors 20 are flange-mounted onto an outer bearing plate 22. In the embodiment shown in FIG. 2, the low-speed drive motor 19 is clamped between an inner bearing plate 18 and an outer detachable bearing plate 23.

As can be seen by referring again to FIG. 1, the two advancing units 12 situated near the ends of the mining machine also act as machine runners. Accordingly, these advancing units are rigidly bolted to the associated machine housing 9 by bolts 24. On the other hand, the advancing units 12 situated between and enclosed by the outer advancing units are connected to them and to one another by plates 14 for limited movement.

Figure 3:
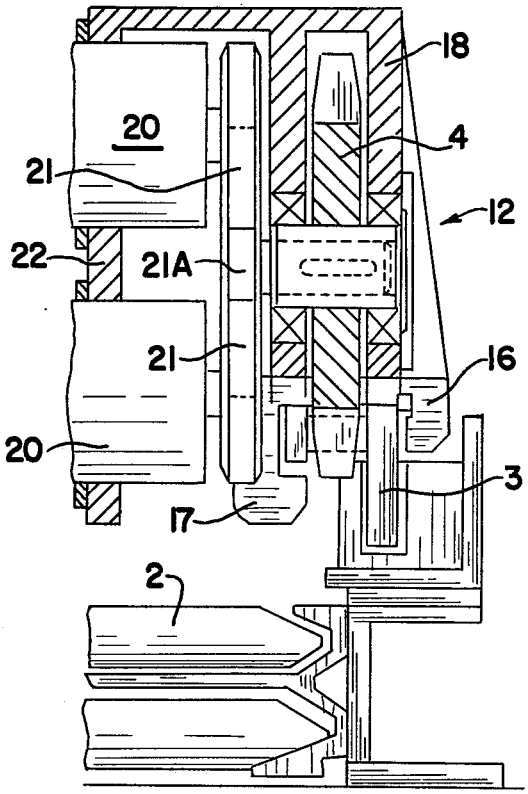
FIG. 3 is a typical sectional view similar to FIG. 2 but illustrating a second embodiment of the present invention.

As described previously, parallel fluid conduit lines supply pressurized fluid from a single pump on the mining machine 1. Since the hydraulic motors 19 of the embodiment of FIGS. 2 and 4 or the hydraulic motors 20 of the embodiment of FIG. 3, are all supplied with fluid in this manner, the drive wheels 4 for each advancing unit receive the same proportion of the load that is incurred for advancing the mining machine along the conveyor. However, for safety reasons, for example, when working greatly inclined seams, some of the advancing units 12 can be supplied with fluid pressure by a second hydraulic fluid circuit.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. An apparatus for advancing a coal-mining machine along a machine track in an underground mine, said apparatus including the combination of rack means having rack teeth to engage with a drive wheel of each of a plurality of advancing means which are separate parts of said coal-mining machine, each of said advancing means including a hydraulic motor with fluid lines extending to a fluid pump means for rotating the drive wheel thereof, each of said advancing means further including a separate carriage bearing and moving on said rack means by a runner to partly engage around the profile of said rack means to insure engagement with the teeth of the drive wheel, at least one of said advancing means being disposed between runners situated on the same side of the coal-mining machine, means for connecting said runners to the body of said coal-mining machine, means for connecting said at least one advancing means to bear only on the runners situated in front thereof in the direction of travel by said coal-mining machine along said machine track, and plate means for interconnecting the runners of each advancing unit, said plate means pointing in the direction of machine travel for enclosing and holding a drive wheel between them, said plate means also enclosing and holding between them the hydraulic motor for said advancing means.

2. The apparatus according to claim 1 wherein some of said plurality of advancing means includes a plurality of hydraulic motors, and gearwheel means for coupling said hydraulic motors to said drive wheel for the advancing means thereof.

3. The apparatus acording to claim 1 wherein said hydraulic motors for the advancing units are each connected to a common fluid supply pipe via fluid connecting lines arranged in a parallel fluid circuit.

4. The apparatus according to claim 1 wherein said coal-mining machine includes at least two hydraulic circuits each having a fluid pump and supplying a pressurized fluid to different ones of the hydraulic motors of said plurality of advancing means.

5. An apparatus for advancing a coal-mining machine along a machine track for an underground mine, said apparatus including the combination of rack means having rack teeth to engage with a drive wheel of each of a plurality of advancing means which are separate parts of said coal-mining machine, each of said advancing means including a hydraulic motor with fluid lines extending to a fluid pump means for rotating the drive wheel thereof, each of said advancing means further including a separate carriage bearing and moving on said rack means while engaged beneath at least part of said rack means to insure engagement with the teeth of the drive wheel, at least one of said advancing means being disposed between runners situated on the same side of the coal-mining machine, means for connecting said runners to the body of said coal-mining machine, means for connecting said at least one advancing means to bear only on the runners situated in front thereof in the direction of travel by said coal-mining machine along said machine track, each of said advancing means includes a curved abutment surface at each opposite ends thereof, and means for interconnecting said advancing means for limited relative movement therebetween.

6. The apparatus according to claim 5 wherein some of said plurality of advancing means includes a plurality of hydraulic motors, and gearwheel means for coupling said hydraulic motors to said drive wheel for the advancing means thereof.

7. The apparatus according to claim 5 wherein said hydraulic motors for the advancing units are each connected to a common fluid supply pipe via fluid connecting lines arranged in a parallel fluid circuit.

8. The apparatus according to claim 5 wherein said coal-mining machine includes at least two hydraulic circuits each having a fluid pump and supplying a pressurized fluid to different ones of the hydraulic motors of said plurality of advancing means.

* * * * *